US011317781B2

(12) United States Patent
Shintani et al.

(10) Patent No.: US 11,317,781 B2
(45) Date of Patent: May 3, 2022

(54) CLEANING TOOL

(71) Applicant: DAIO PAPER CORPORATION, Shikokuchuo (JP)

(72) Inventors: Naoki Shintani, Shikokuchuo (JP); Asako Fushimi, Shikokuchuo (JP)

(73) Assignee: DAIO PAPER CORPORATION, Ehime (JP)

( * ) Notice: Subject to any disclaimer, the term of this patent is extended or adjusted under 35 U.S.C. 154(b) by 146 days.

(21) Appl. No.: 16/618,454

(22) PCT Filed: May 24, 2018

(86) PCT No.: PCT/JP2018/019928
§ 371 (c)(1),
(2) Date: Dec. 2, 2019

(87) PCT Pub. No.: WO2018/230293
PCT Pub. Date: Dec. 20, 2018

(65) Prior Publication Data

US 2020/0113402 A1 Apr. 16, 2020

(30) Foreign Application Priority Data

Jun. 14, 2017 (JP) ..... JP2017-116567

(51) Int. Cl.
*A47L 13/254* (2006.01)
*A47L 13/16* (2006.01)
*A47L 13/42* (2006.01)

(52) U.S. Cl.
CPC ..... *A47L 13/254* (2013.01); *A47L 13/16* (2013.01); *A47L 13/42* (2013.01)

(58) Field of Classification Search
CPC ..... A47L 13/24; A47L 13/254; A47L 13/255; A47L 13/256; A47L 13/29; A47L 13/16; A47L 13/42
(Continued)

(56) References Cited

U.S. PATENT DOCUMENTS 3,261,049 A * 7/1966 Murphy ..... A47L 13/20 15/147.2
3,465,377 A * 9/1969 Thomas ..... A47L 13/29 15/147.1
(Continued)

FOREIGN PATENT DOCUMENTS

CN 1166311 A * 12/1997
CN 1166311 A 12/1997
(Continued)

OTHER PUBLICATIONS

Chinese Office Action dated Dec. 3, 2020 of corresponding application No. 201880036857.5; 11 pgs.
(Continued)

*Primary Examiner* — Marc Carlson
(74) *Attorney, Agent, or Firm* — Maier & Maier, PLLC

(57) ABSTRACT

The present disclosure has a head part 1 for attaching a cleaning sheet P, and a handle part 2 that is connected to the head part 1 and is for a user to grasp, wherein a plurality of line-shaped ribs, which are formed so as to be line-shaped a bottom surface view of the head part 1, are formed in a bottom surface of the head part 1. A cleaning tool that can improve the collection of dirt with a cleaning sheet can thus be provided.

19 Claims, 7 Drawing Sheets

(58) Field of Classification Search
USPC ..... 15/147.1, 147.2, 228, 231, 232
See application file for complete search history.

(56) References Cited

U.S. PATENT DOCUMENTS

| | | | | | |
|---|---|---|---|---|---|
| 3,775,802 | A * | 12/1973 | Grassman | A47L 13/254 | 15/147.2 |
| 3,792,505 | A * | 2/1974 | Saltzstein | A47L 13/256 | 15/147.2 |
| 4,852,210 | A * | 8/1989 | Krajicek | A47L 13/20 | 15/228 |
| 7,428,768 | B2 * | 9/2008 | Dingert | A47L 13/256 | 15/231 |
| 7,996,948 | B2 * | 8/2011 | Kaminer | A47L 13/256 | 15/209.1 |
| 8,793,831 | B2 * | 8/2014 | Katou | B25G 1/04 | 15/228 |
| 10,285,558 | B2 * | 5/2019 | O'Shea | A47L 13/256 | |
| 2004/0244133 | A1 * | 12/2004 | Li | A47L 13/256 | 15/228 |
| 2007/0151063 | A1 * | 7/2007 | Decoopman | B29C 45/1676 | 15/231 |
| 2009/0139045 | A1 * | 6/2009 | Cannon | A47L 13/256 | 15/228 |
| 2009/0223540 | A1 * | 9/2009 | Rosenzweig | A47L 13/44 | 134/105 |
| 2009/0241280 | A1 * | 10/2009 | Pho | A47L 13/256 | 15/209.1 |
| 2013/0000064 | A1 * | 1/2013 | Katou | B25G 1/04 | 15/209.1 |
| 2014/0013531 | A1 * | 1/2014 | Tuman | A47L 13/44 | 15/231 |
| 2017/0215686 | A1 * | 8/2017 | Smith | A47L 13/256 | |

FOREIGN PATENT DOCUMENTS

| | | | | | |
|---|---|---|---|---|---|
| CN | 101909505 | A | | 12/2010 | |
| CN | 102727148 | A | | 10/2012 | |
| CN | 102753076 | A | | 10/2012 | |
| CN | 102727148 | B | * | 8/2014 | |
| EP | 2534994 | A1 | | 12/2012 | |
| GB | 2411578 | A | | 9/2005 | |
| JP | 06-78872 | | * | 3/1994 | |
| JP | 09-135799 | | * | 5/1997 | |
| JP | 109135799 | A | | 5/1997 | |
| JP | H09224896 | A | | 9/1997 | |
| JP | 10-52391 | A | | 2/1998 | |
| JP | 2009-201962 | A | | 9/2009 | |
| JP | 2012-147958 | | * | 8/2012 | |
| JP | 2013-13633 | | * | 1/2013 | |
| JP | 2013-31652 | | * | 2/2013 | |
| JP | 2013-169237 | A | | 9/2013 | |
| JP | 2013-176703 | A | | 9/2013 | |
| JP | 2016-123494 | | * | 7/2016 | |
| JP | 2017042181 | A | | 3/2017 | |
| WO | 2005084516 | A1 | | 9/2005 | |
| WO | WO-2008124341 | A1 | * | 10/2008 | A47L 13/254 |
| WO | 2009085624 | A1 | | 7/2009 | |
| WO | WO-2018173822 | A1 | * | 9/2018 | |
| WO | WO-2018230292 | A1 | * | 12/2018 | A47L 13/16 |
| WO | WO-2018230310 | A1 | * | 12/2018 | A47L 13/16 |

OTHER PUBLICATIONS

Supplementary European Search Report and European Search Opinion dated May 26, 2020 of corresponding application No. EP18818530; 7 pgs.
Japanese Office Action dated Dec. 18, 2018 of corresponding application No. 2017116567; 8 pgs.
Decision to Grant a Patent dated Feb. 19, 2019 of corresponding application No. 2017116567; 5 pgs.
Translation of International Search Report dated Aug. 14, 2018 and Written Opinion of corresponding application No. PCT/JP2018/019928; 8 pgs.
Chinese Office Action dated Jul. 7, 2021 of corresponding application No. 201880036857.5; 12 pgs.
Office Action dated Jan. 6, 2022, in connection with corresponding Chinese Application No. 201880036857.5 (11 pp., including machine-generated English translation).

* cited by examiner

CLEANING TOOL

FIELD

The present invention relates to a cleaning tool.

BACKGROUND

Conventionally, a prior art proposes a technique for a cleaning tool for cleaning a floor surface that includes a head part to which a cleaning sheet is attached, a handle part for a user to grip the cleaning tool and a joint part for connecting the head part to the handle part, in which the head part and the handle part are rotatably connected through the joint part.

In such a cleaning tool, the efficiency of cleaning depends on a back-side shape of the head part attached to the cleaning sheet, and therefore, the shapes of the back surface of the head part is variously devised in order to use the cleaning sheet efficiently. For example, a prior art proposes a cleaning tool in which the back side of the head part is formed in a wave cross-sectional shape as a convex part and a concaves part are arranged alternately and a convex rib in a dot shape is provided on the convex part (refer to Patent Literature 1). Another prior art proposes a cleaning tool having multiple scraping projections on the back-side of the head part (refer to Patent Literature 2).

Patent Literature 1: Japanese Patent Publication No. 2013-176703

Patent Literature 2: Japanese Patent Publication No. 2013-169237

SUMMARY

A dust collection property of a cleaning sheet used for a cleaning tool may be improved by having changes in the way to contact the floor surface instead of the entire surface pushing onto the floor surface homogeneously. Therefore, a technique has proposed to improve the dust collection property by providing parts supported with the back-side of the head part and parts not supported with the back-side of the head part to the cleaning sheet and having changes in the way to contact the floor surface.

However, according to the cleaning tools of Patent Literatures above, since ribs or the projections on the back-side of the head part were formed in a dot shape or a fine shape close to the dot shape in a plan view and were not able to support the cleaning sheet enough and therefore, the dust collection property of the cleaning sheet was not improved sufficiently.

The object of the present invention is to provide the cleaning tool that improves the dust collection property of the cleaning sheet.

In order to achieve the object of the invention, a first aspect of the present invention is directed to a cleaning tool that includes a head part to which a cleaning sheet is attached and a handle part connected to the head part for a user to grip, and in a bottom surface view of the head part, a plurality of line-shaped ribs are formed as they become linear on the bottom surface of the head part.

According to the invention, it is possible to provide the cleaning tool which exhibits an improvement in the dust collection property of the cleaning sheet.

A second aspect of the present invention is, as in the cleaning tool according to the first aspect, that the head part is formed in a rectangular shape in a plan view and the line-shaped ribs in the bottom surface view of the head part include oblique-line ribs inclining from the central part of the short side direction to the edge part of the short side direction and toward the central part direction of the longitudinal side direction, as inclining parallel to the short side direction of the head part.

According to the invention, it is possible to provide the cleaning tool which exhibits an improvement in the dust collection property of the cleaning sheet.

A third aspect of the present invention is, as in the cleaning tool according to the first or second aspect, that the line-shaped ribs include rhombus-shaped ribs arranged as they become substantially rhomboid shapes in the bottom surface view.

According to the invention, it is possible to provide the cleaning tool which exhibits an improvement in the dust collection property of the cleaning sheet.

A fourth aspect of the present invention is, as in the cleaning tool according to any one of the first, second or third aspect, that lengths of the line-shaped ribs are 1 mm to 100 mm.

According to the invention, it is possible to provide the cleaning tool which exhibits an improvement in the dust collection property of the cleaning sheet.

A fifth aspect of the present invention is, as in the cleaning tool according to any one of the first, second, third or fourth aspect, that the line-shaped ribs are formed as to have convex configurations with 0.1 to 2 mm in height downward from the bottom surface of the head part.

According to the invention, it is possible to provide the cleaning tool which exhibits an improvement in the dust collection property of the cleaning sheet.

A sixth aspect of the present invention is, as in the cleaning tool according to any one of the first, second, third, fourth or fifth aspect, that recessed-shape part is formed on the head part as to be recessed upward at positions close to edges in the bottom surface view and the line-shaped ribs are formed on the bottom surface of the head part except the area of the recessed-shape part.

According to the invention, it is possible to provide the cleaning tool which exhibits an improvement in the dust collection property of the cleaning sheet.

According to the present invention, it is possible to provide the cleaning tool which exhibits an improvement in the dust collection property of the cleaning sheet.

DETAILED DESCRIPTION

Hereinafter, specific aspects of a cleaning tool 100 according to an embodiment of the present invention will be described while referring to FIG. 1 to FIG. 8. However, the technical scope of the invention is not limited to the shown examples.

Figure 1:
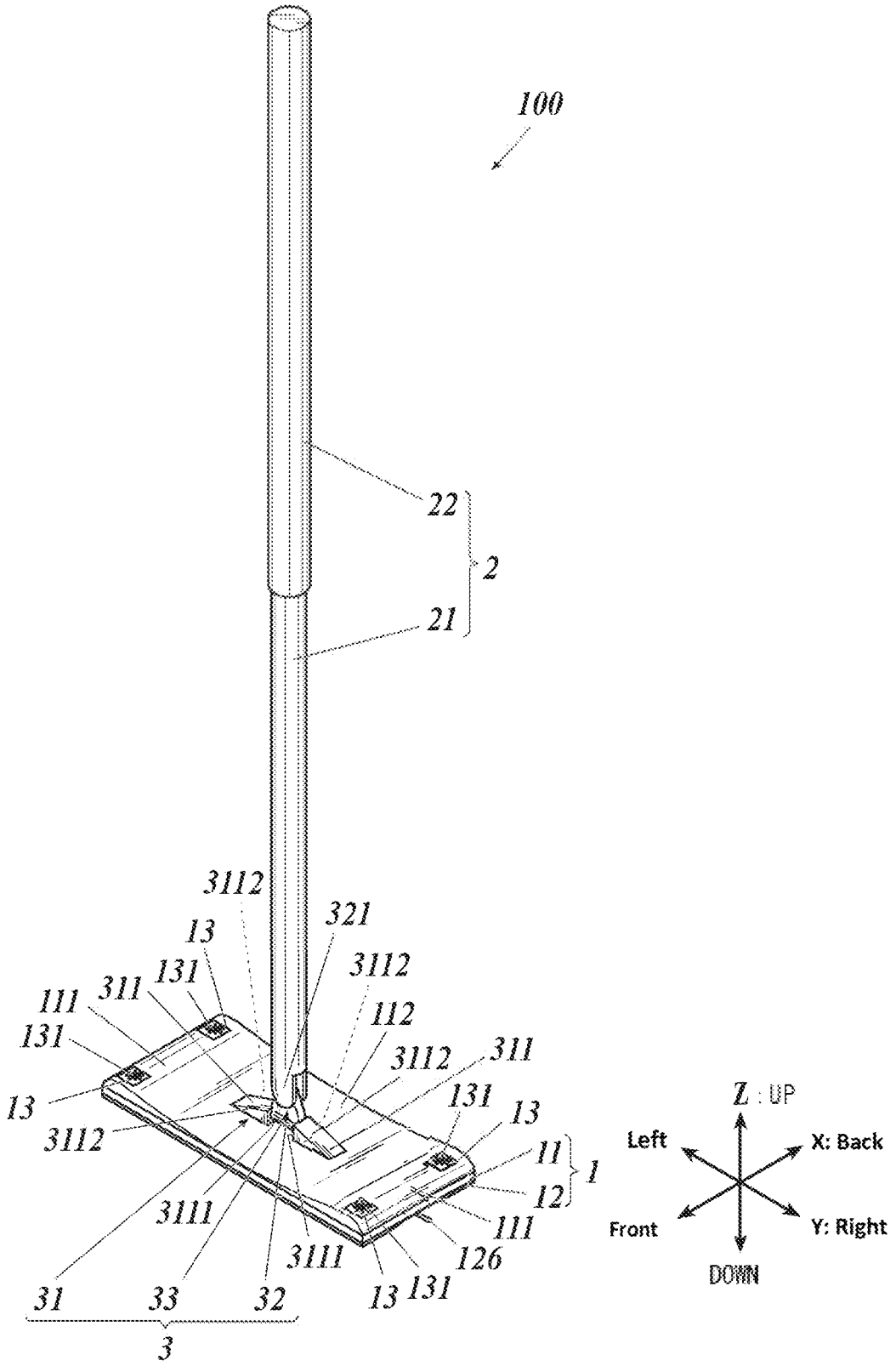
FIG. 1 is a perspective view of the cleaning tool according to the embodiment.

For convenience, as shown in FIG. 1. X-axis, Y-axis and Z-axis directions as well as a front-and-back direction, a left-and-right direction and an up-and-down direction are defined and described. Further, in descriptions hereinafter, a plan view is defined as the view from the top, a bottom surface view is defined as the view from the bottom, a front view is defined as the view from the front and a side view is defined as the view from right or left according to FIG. 1.

(Structure of Embodiment)

The cleaning tool 100 includes a head part 1 to which a cleaning sheet P is attached, a handle part 2 for a user to grip the cleaning tool 100 and a joint part 3 connecting the head part 1 to the handle part 2.

(Head Part)

Figure 2:
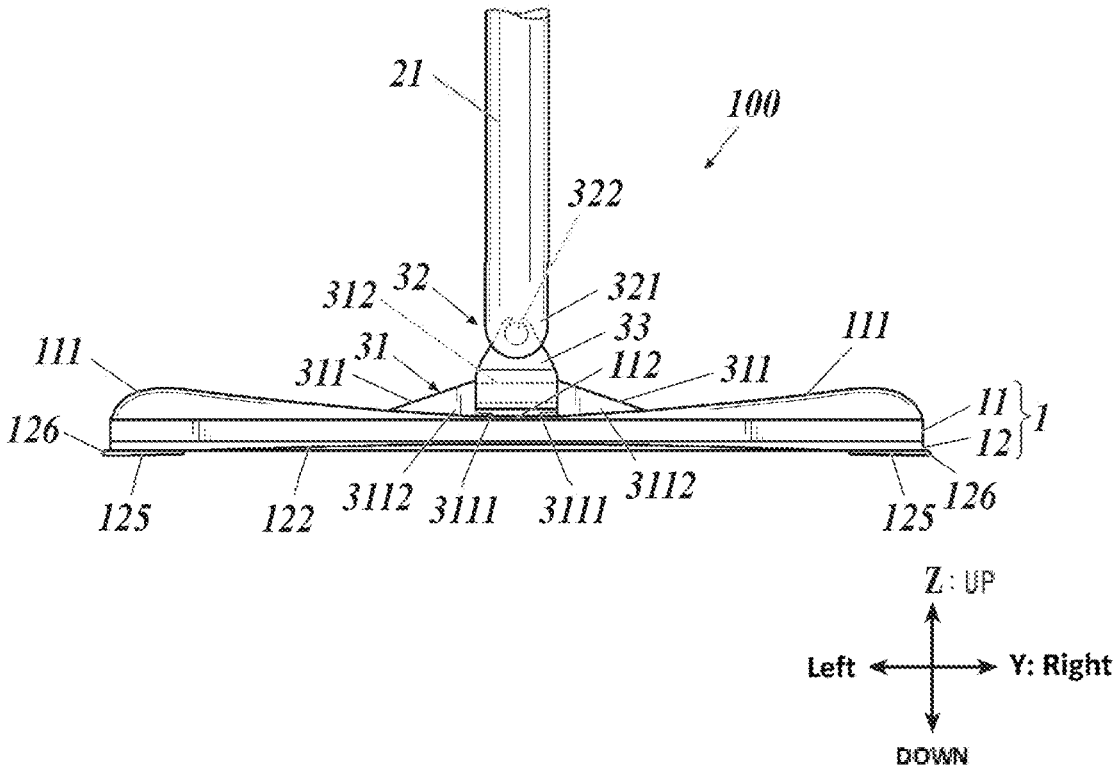
FIG. 2 is a front view of the cleaning tool according to the embodiment. An upper part of the handle part is omitted.
Figure 3:
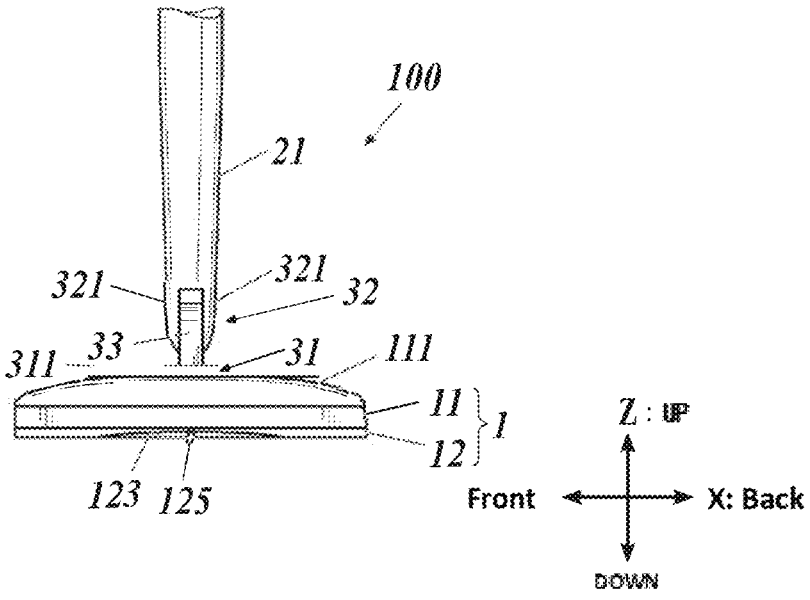
FIG. 3 is a side view of the cleaning tool according to the embodiment. The upper part of the handle part is omitted.

The head part 1 is formed by a top surface part 11 and a bottom surface part 12 which are made of different materials, and the handle part 2 is attached to an approximately central part on an upper surface of the top surface part 11 through the joint part 3 as shown in FIG. 1, FIG. 2 and FIG. 3.

(Top Surface Part)

The top surface part 11 is an approximately rectangular shape in a plan view being elongated in the Y-axis direction with a size of 50 mm to 150 mm, preferably 70 mm to 120 mm in the X-axis direction, and 200 mm to 300 mm, preferably 220 mm to 270 mm in the Y-axis direction, which is formed of a hard material such as ABS resin (acrylonitrile, butadiene, styrene copolymer synthetic resin).

As shown in FIG. 2 an upper surface side of the top surface part 11 is formed so that portions close to both end parts in the Y-axis direction are higher and portions close to the central part in the Y-axis direction are lower, and further, raised parts 111 are formed closed to the both end parts in the Y-axis direction and a sunk part 112 is formed close to the central part in the Y-axis direction.

A lower surface side of the top surface part 11 is formed to have a flat surface and attached to the upper surface side of the bottom surface part 12.

(Raised Part)

As shown in FIG. 2, the raised parts 111 are formed to be raised upward close to the both end parts in the Y-axis direction on the upper surface side of the top surface part 11 in the front view. As shown in FIG. 3, the raised part 111 is formed so as to gradually raised from the front-and-back direction toward the central part in the X-axis direction so that portions close to the central part in the X-axis direction are the highest in the side view.

The raised part 111 is formed so that a thickness of the head part 1 is 10 mm to 30 mm, preferably 15 mm to 25 mm at the highest part. When the thickness of the head part 1 is lower than 10 mm, it is difficult to insert a finger at the time of attaching the sheet to later-described attachment parts 13 and the sheet may come off easily. When the thickness of the head part 1 is higher than 30 mm, entering to places under furniture with low legs such as under a couch or a rack may become difficult.

Specific arrangement positions and shapes of the raised parts 111 are not limited to the embodiment above and may be suitably altered with a condition that the raised parts 111 can be lifted when the handle part 2 climbs over first protruding parts 311.

It is preferable that the raised parts 111 are formed close to the both end parts in a longitudinal direction of the head part 1 in a plan view, however, the invention is not limited as long as the raised parts 111 are formed close to both end parts in the same direction as a direction in which two first protruding parts 311 of a later-described first yoke part 31 are aligned.

(Sunk Part)

As shown in FIG. 2, the sunk part 112 is formed so as to gradually sink from the raised parts 111 formed at both end parts to close to the central part in the Y-axis direction on the upper surface side of the top surface part 11.

The sunk part 112 is formed so that a thickness of the head part 1 is 15 mm or less, preferably 12 mm or less at the central part of the top surface part 11 to which the handle part 2 is attached through the joint part 3.

(Bottom Surface Part)

As shown in FIG. 1, FIG. 2 and FIG. 3, the bottom surface part 12 is formed of a softer material than that of the top surface part 11, which can be elastically deformed such as TPE (thermoplastic elastomer) so as to have a rectangular shape approximately congruent with the top surface part 11 in a plan view. The bottom surface part 12 is formed to have a thickness of 1 mm to 10 mm, preferably 3 mm to 4 mm in the Z-axis direction.

A rubber hardness of the material to be used is preferably 60 to 100 (a value measured by a durometer type A (Shore A) standardized by JIS K 6253) from a viewpoint of the dust collection property.

The bottom surface part 12 is formed so that the upper surface side is approximately parallel to the lower surface side, and is connected to the top surface part 11 on the upper surface side.

(Flat Surface Part and Recessed Part)

Figure 4:
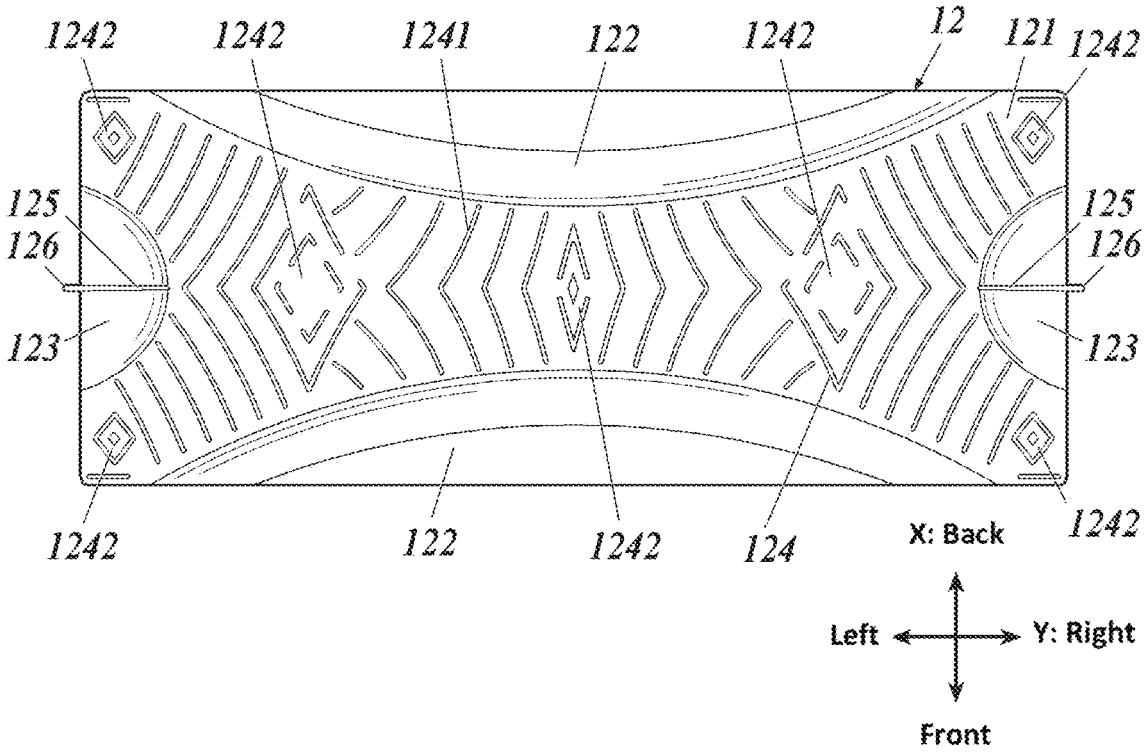
FIG. 4 is a bottom surface view of the head part.

As shown in FIG. 4, on the lower surface side of the bottom surface part 12, a flat surface part 121, longitudinal-edge recessed parts 122 and transverse-edge recessed parts 123 are formed.

(Flat Surface Part)

As shown in FIG. 4, the flat surface part 121 is a portion formed on an approximately flat surface except for later-described linear-shaped ribs 124, which is the portion other than the longitudinal-edge recessed parts 122 and the transverse-edge recessed parts 123 on the lower surface side of the bottom surface part 12.

The bottom surface part 12 corresponds to the entire member formed by an elastically deformable material forming the lower side of the head part 1, and the flat surface part 121 corresponds to a portion formed on the approximately flat surface of the lower surface of the bottom surface part 12.

(Longitudinal-Edge Recessed Part)

As shown in FIG. 2 and FIG. 4, the longitudinal-edge recessed parts 122 are portions formed to be recessed upward at positions close to both end parts in the short-side direction (X-axis direction) on the lower surface side of the bottom surface part 12. According to the parts, portions close to both end parts in the short-side direction (X-axis direction) on the lower surface side of the head part 1 do not closely contact the floor surface, and gaps are generated between the head part 1 and the floor surface when using the cleaning tool 100.

The longitudinal-edge recessed parts 122 may be formed in an arbitrary shape as far as gaps can be generated between the floor surface and the lower surface side close to the both end parts in the short-side direction (X-axis direction) of the head part 1, however, it is preferable that the longitudinal-edge recessed part 122 is formed as the lower surface side of the bottom surface part 12 is recessed to the largest degree at the central part in the Y-axis direction of the end parts on the front side or the back side of the head part 1, and the recess is gradually reduced as going away from that part to be connected to the flat surface part 121 smoothly.

The longitudinal-edge recessed part 122 is formed to be 0.1 mm to 5 mm recessed upward, more preferably 0.5 mm to 3 mm, as compared with the flat surface part 121 at the most recessed part.

As the longitudinal-edge recessed parts 122 are formed on the lower surface side of the bottom surface part 12, dust on the floor surface is introduced to the lower surface of the head part 1 without being gathered at end parts on front and back of the head part 1 when cleaning the floor surface by moving the cleaning tool 100 in the short-side direction (X-axis direction) of the head part 1, and as a result, the dust collection property may be improved.

(Transverse-Edge Recessed Part)

As shown in FIG. 3 and FIG. 4, the transverse-edge recessed parts 123 are portions formed to be recessed upward at positions close to both end parts in the longitudinal direction (Y-axis direction) on the lower surface side of the bottom surface part 12. According to the parts, portions close to both end parts in the longitudinal direction (Y-axis direction) on the lower surface side of the head part 1 do not closely contact the floor surface, and gaps are generated between the head part 1 and the floor surface when using the cleaning tool 100.

The transverse-edge recessed parts 123 may be formed in an arbitrary shape as far as gaps can be generated between the floor surface and the lower surface side close to the both end parts in the longitudinal direction (Y-axis direction) of the head part 1, however, it is preferable that the transverse-edge recessed part 123 is formed as the lower surface side of the bottom surface part 12 is recessed to the largest degree at the central part in the X-axis direction of the end parts on the right side or the left side of the head part 1 and the recess is gradually reduced as going away from that part to be connected to the flat surface part 121 smoothly.

The transverse-edge recessed part 123 is formed to be recessed 0.1 mm to 5 mm upward, more preferably 0.5 mm to 3 mm, as compared with the flat surface part 121 at the most recessed part.

As the transverse-edge recessed parts 123 are formed on the lower surface side of the bottom surface part 12, dust on the floor surface is introduced to the lower surface of the head part 1 without being gathered at end parts on left and right of the head part 1 when cleaning the floor surface by moving the cleaning tool 100 in the longitudinal direction (Y-axis direction) of the head part 1, and as a result, the dust collection property may be improved.

(Line-Shaped Ribs)

As shown in FIG. 4, on the flat surface part 121 of the lower surface side of the bottom surface part 12, the line-shaped ribs 124 which are convex downward are formed so as to be a linear shape in the bottom surface view.

All the line-shaped ribs 124 are formed so as to have the same height in the Z-axis direction, specifically, formed to protrude downward by 0.1 mm to 2 mm, more preferably 0.2 mm to 1 mm. Each line-shaped rib is formed in a liner shape with a length of 1 mm to 100 mm, more preferably 8 mm to 85 mm, and a width of 0.1 mm to 2 mm, more preferably 0.2 mm to 1.2 mm.

The line-shaped ribs 124 include both ribs formed in linear shapes in the bottom surface view and ribs formed in curved shapes in the bottom surface view.

The line-shaped ribs 124 includes the oblique-line ribs 1241 and rhombus-shaped ribs 1242, and specific arrangements are as follows.

(Oblique-Line Ribs)

The oblique-line ribs 1241 are portions other than the rhombus-shaped ribs 1242, which are formed on the almost entire surface of the flat surface part 121.

As shown in FIG. 4, in the bottom surface view of the head part 1, the oblique-line ribs 1241 are formed in linear shapes inclined from the central part in the X-axis direction on the bottom surface of the head part 1 toward the central part in the Y-axis direction as coming toward the front direction or the back direction and inclined from a direction parallel to the X-axis.

Further, the oblique-line ribs 1241 are formed in a line-symmetry to the front-and-back direction as the central part in X-axis direction of the back surface of the head part 1 to be the symmetry axis and formed in a line-symmetry to the left-and-right direction as the central part in Y-axis direction of the back surface of the head part 1 to be the symmetry axis.

(Rhombus-Shaped Ribs)

As shown in FIG. 4 the rhombus-shaped ribs 1242 are portions where the line-shaped ribs are arranged on approximately rhombus shapes in the bottom surface view, which are formed at the central part in the X-axis direction and the Y-axis direction, at two places where the central part in X-axis direction and midpoints between the central part and end parts in the Y-axis direction, and at four places near four corners on the lower surface of the head part 1 in the flat surface part 121.

(End-Part Ribs)

End-part ribs 125 formed in linear shapes along the Y-axis direction are arranged at the central part in the X-axis direction on the lower surface side close to the both end parts in the longitudinal direction (Y-axis direction) on the lower surface side of the bottom surface part 12.

The end-part ribs 125 are formed to have a height of 1 mm to 5 mm downward when viewed from the flat surface part 121. When the height is lower than 1 mm, it is difficult to clean a groove sufficiently, and when the height is higher than 5 mm, there is an increased possibility of being an obstruction at the time of cleaning a flat surface on the floor. However, it is necessary that the end-part ribs 125 are formed to be higher than the line-shaped ribs 124 in the Z-axis direction.

As shown in FIG. 4, it is necessary that the end-part ribs 125 are formed to have the height described above with respect to the flat surface part 121 also in the case where the end-part ribs 125 are formed so as to overlap with the transverse-edge recessed parts 123.

Moreover, the end-part ribs 125 are formed so that a length in the Y-axis direction is 10 mm to 50 mm, more preferably 20 mm to 30 mm, and a width in the X-axis direction is 0.1 mm to 3 mm, more preferably 0.5 mm to 1.5 mm.

As the end-part ribs 125 are provided, not only the flat surface part on the floor but also the groove may be cleaned by allowing the ribs to enter the groove on the floor surface.

(End-Part Protrusions)

As shown in FIG. 1, FIG. 2 and FIG. 4, in central parts in the X-axis direction of both end parts in the longitudinal direction (Y-axis direction) of the head part 1, end-part protrusions 126 are formed protruding in the Y-axis direction so as to be continued from the end-part ribs 125. The end-part protrusions 126 are formed to protrude to the right direction and the left direction from both end parts in the longitudinal direction (Y-axis direction) of the head part 1 by 0.5 mm to 3 mm, more preferably 0.8 mm to 2 mm.

(Attachment Parts)

As shown in FIG. 1, the attachment parts 13 are provided close to four corners on the upper surface of the top surface part 11 in a plan view. The attachment parts 13 are holes with claw parts 131 formed of EVA (ethylene-vinyl acetate copolymer) or the like around the holes, which are arranged on the raised parts 111 on the upper surface of the top surface part 11. The cleaning sheet P can be attached to the head part 1 by pushing the cleaning sheet P to be caught by the claw parts 131. Specifically, the cleaning sheet P is closely contacted to the lower surface side of the bottom surface part 12, and portions of the cleaning sheet P protruding from the lower surface side of the bottom surface part 12 are folded to the upper surface side of the top surface part 11 and pushed into the attachment parts 13 provided on the upper surface side of the top surface part 11, thereby attaching the cleaning sheet P to the head part 1.

The shape of the attachment parts 13 is not limited to the shape described above as far as the cleaning sheet P can be attached to the head part 1.

(Handle Part)

The handle part 2 is a bar-shaped member used for being gripped by a user when using the cleaning tool 100, including a handle body 21 and a grip part 22 as shown in FIG. 1. The handle part 2 is rotatably connected to the head part 1 through the joint part 3. Explanation herein will be made by designating the front-and-back direction, the left-and-right direction and the up-and-down direction in a state where the handle part 2 stands on the head part 1 vertically as shown in FIG. 1.

(Handle Body)

As shown in FIG. 1, the handle body 21 is a bar-shaped member formed of a hard material such as ABS resin (acrylonitrile, butadiene, styrene copolymer synthetic resin), which is connected to the approximately central part on the upper surface side of the top surface part 11 of the head part 1 through the joint part 3 at a lower end and connected to the grip part 22 at an upper end part.

As shown in FIG. 3, the handle body 21 is formed so that a thickness in the front-and-back direction is reduced as compared with a thickness in the left-and-right direction at a portion close to the lower end part. Accordingly, it becomes easy to lay the handle part 2 in a lower state.

It is possible that the portion close to the lower end part of the handle body 21 is formed to have the same thickness in the front-and-back direction and the right-and-left direction though the effect that the handle part 2 can be easily laid in the lower state is reduced. Further, the thickness in the front-and-back direction may be larger than the thickness in the left-and-right direction by giving weight to, for example, strength of later-described second protruding parts 321.

(Grip Part)

Grip part 22 is a portion where a user grips when using the cleaning tool 100 and is formed of a softer material than the handle body 21 such as polypropylene or polyacetal, and as shown in FIG. 1, it is connected to the handle body 21 at the lower end part.

(Joint Part)

As shown in FIG. 1, FIG. 2 and FIG. 3, the joint part 3 is formed by the first yoke part 31 provided in the approximately central part on the upper surface side of the top surface part 11 of the head part 1, a second yoke part 32 provided at a lower end part of the handle part 2 and a connecting part 33 connecting the first yoke part 31 and the second yoke part 32.

(First Yoke Part)

Figure 5:
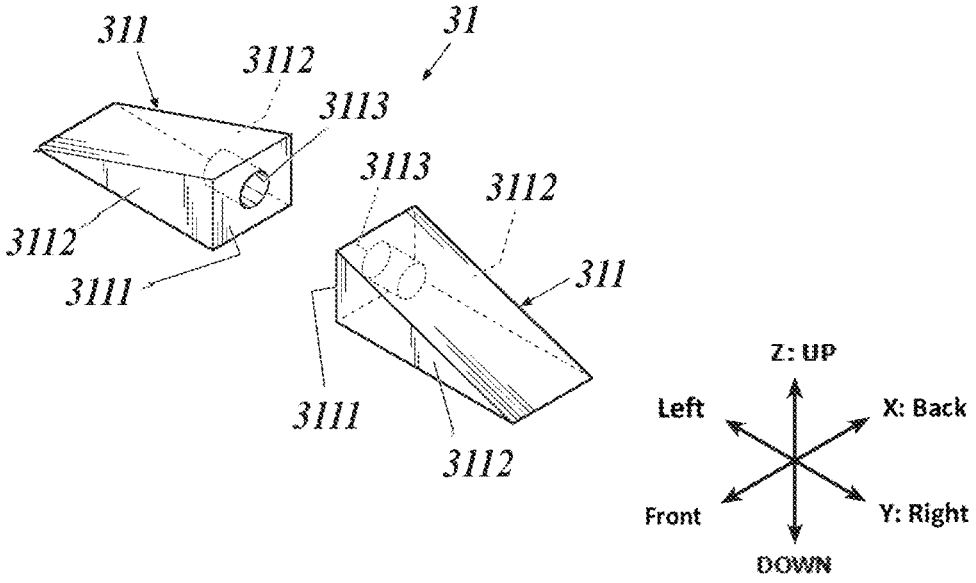
FIG. 5 is a perspective view of a first yoke part in the joint part of the cleaning tool according to the embodiment.

As shown in FIG. 1. FIG. 2. FIG. 3 and FIG. 5, the first yoke part 31 is formed by two symmetrical first protruding parts 311 facing at first facing surface parts 3111, which are formed integrally with the top surface part 11 at the central part on the upper surface side of the top surface 11 of the head part 1. In the embodiment, a portion used for connecting to another member formed with two symmetrical protrusions is called the "yoke part."

(First Protruding Part)

As shown in FIG. 1. FIG. 2, FIG. 3 and FIG. 5, the first protruding parts 311 are formed so as to be gradually increased in height toward the first facing surface parts 3111 where the first protruding parts 311 face each other when viewed from the X-axis direction and are arranged side by side in the Y-axis direction.

The first protruding parts 311 are formed to have 5 mm to 20 mm, more preferably 8 mm to 15 mm in the X-axis direction and to have 10 mm to 50 mm, more preferably 15 mm to 30 mm in the Y-axis direction. The first protruding parts 311 are formed to have 5 mm to 15 mm, more preferably 8 mm to 12 mm in the Z-axis direction so as to be the same height or higher than the raised parts 111 at portions close to the first facing surface parts 3111 at the highest part. Further, the first protruding parts 311 are arranged so that the first facing surface parts 3111 have a distance of 10 mm to 25 mm, more preferably 15 mm to 20 mm therebetween.

(First Facing Surface Parts)

As shown in FIG. 1. FIG. 2 and FIG. 5, the first facing surface parts 3111 are surfaces where the first protruding parts 311 face each other, which are formed to have an approximately rectangular shape standing almost vertically from the upper surface side of the top surface part 11 so that the first facing surface parts 311 are parallel to each other.

Moreover, hole parts 3113 are formed in the first facing surface parts 3111 as shown in FIG. 5.

(Hole Parts)

The hole parts 3113 are cylindrical holes formed in the first facing surface parts 3111 and used for connecting to a first rotating axial center part 331 of the connecting part 33, which is described later.

(Side Surface Pails)

As shown in FIG. 1, FIG. 2 and FIG. 5, side surface parts 3112 are surfaces facing the X-axis direction parallel to a YZ plane in the first protruding parts 311 and formed continuously from both front and back sides of the first facing surface parts 3111, which are formed so as to stand almost vertically from the upper surface side of the top surface part 11 of the head part 1.

(Second Yoke Part)

Figure 6:
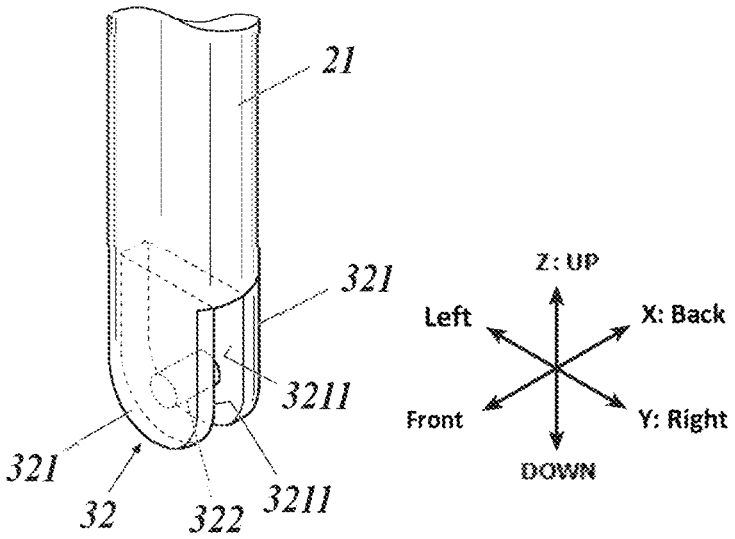
FIG. 6 is a perspective view of a lower part of the handle part and a second yoke part in the joint part of the cleaning tool according to the embodiment.

As shown in FIG. 1. FIG. 2, FIG. 3 and FIG. 6, the second yoke part 32 is formed by two symmetrical second protruding parts 321 extending in the axial direction at a lower end part of the handle body 21 of the handle part 2 and a second axial member 322 bridging over between second facing surface parts 3211 of the second protruding parts 321.

(Second Protruding Part)

As shown in FIG. 1. FIG. 3 and FIG. 6, the second protruding parts 321 are integrally formed with the handle body 21 so that the second facing surface parts 3211 face each other in parallel at both end parts in the X-axis direction in the state shown in FIG. 1 of the lower end of the handle body 21.

The second protruding parts 321 have a thickness of 2 mm to 6 mm, preferably 3 mm to 5 mm in the X-axis direction and a width approximately the same as that of the handle body 21 in the Y-axis direction in the state shown in FIG. 1. If the thickness in the X-axis direction is too thin, the strength is insufficient when being pressed at the time of cleaning and it may lead to breakage easily. If the thickness is too thick, the handle interferes with an upper surface of the head part when the handle is laid in the X-direction, and it may be difficult to lean the handle to an approximately parallel state.

The second facing surface parts 3211 are arranged so as to have a distance of 2 mm to 10 mm, more preferably 3 mm to 7 mm therebetween.

(Second Axial Member)

As shown in FIG. 6, the second axial member 322 is formed integrally with the second protruding parts 321 so as to be bridging along the X-axis direction at the central part in the Y-axis direction between the second facing surface parts 3211.

(Connecting Part)

Figure 7:
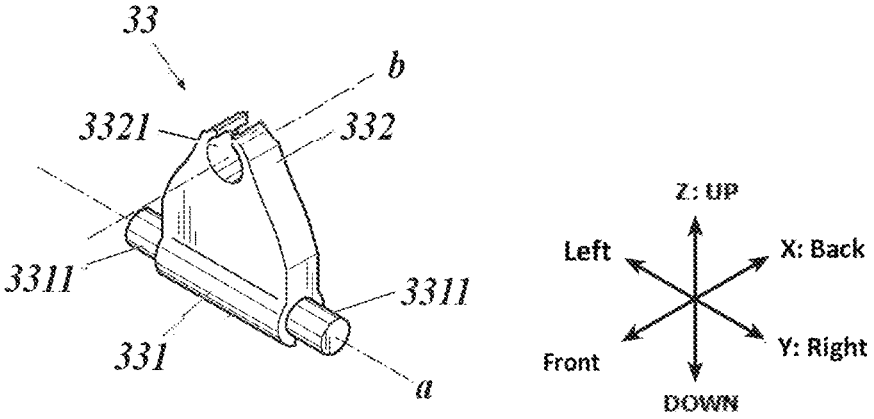
FIG. 7 is a perspective view of the connecting part in the joint part of the cleaning tool according to the embodiment.

The connecting part 33 is provided in a manner of being interposed between the first yoke part 31 and the second yoke part 32 as shown in FIG. 1, FIG. 2 and FIG. 3, is formed in an approximately triangular shape when viewed from the X-axis direction and includes the first rotating axial center part 331 and a second rotating axial center part 332 that are orthogonal to each other without central axes crossing each other three-dimensionally as shown in FIG. 7.

As a material for forming the connecting part 33, for example, polyacetate may be used.

(First Rotating Axial Center Part)

As shown in FIG. 7, the first rotating axial center part 331 is a portion used for connecting to the first yoke part 31 formed in the lower end part of the connecting part 33 and includes columnar protruding parts 3311 at both end parts in the Y-axis direction.

The first rotating axial center part 331 is formed so that a width of a portion other than the protruding parts 3311 in the Y-axis direction is approximately the same as the distance between the first facing surface parts 3111 of the first protruding parts 311 and in addition, the protruding parts 3311 have the approximately the same shape as the hole parts 3113. Therefore, the connecting part 33 can be attached to the first yoke part 31 so as to rotate about the Y-axis direction by fitting the protruding parts 3311 to the hole parts 3113.

A central axis of the first rotating axial center part 331 along the Y-axis direction as shown in FIG. 7 is set as a first axial center "a."

(Second Rotating Axial Center Part)

As shown in FIG. 7, the second rotating axial center part 332 is a portion used for connecting to the second yoke part 32 formed in an upper end part of the connecting part 33 and have a second mounting hole part 3321 in an approximately cylindrical shape piercing in the front-and-back direction with part in the upper end part being cut out. A diameter of a cylindrical space formed inside of the second mounting hole part 3321 is approximately the same as a diameter of the second axial member 322. A length in the X-axis direction is formed to be approximately the same as a length of the second axial member 322, and the connecting part 33 can be fixed to the second yoke part 32 so as to rotate about the X-axis direction by fitting the second axial member 322 to the second mounting hole part 3321.

A central axis of the second rotating axial center part 332 along the X-axis direction as shown in FIG. 7 is set as a second axial center "b."

(Advantages of Embodiment)

According to the embodiment, when cleaning with the cleaning sheet P attached to the bottom surface of the head part 1, there are sections of the cleaning sheet P that are pushed onto the floor surface by being supported with line-shaped ribs 124 and that are not pushed onto the floor surface. Therefore, the cleaning sheet P does not contact the floor surface homogeneously, and as a result, the dust collection property by the cleaning sheet P may be improved. Specifically, the cleaning sheet P is supported sufficiently because the ribs are formed in line-shapes, and therefore, it is possible to obtain the efficiency described above.

Supporting the cleaning sheet P becomes easier by forming the oblique-line ribs 1241 as shown in FIG. 4, and the efficiency described above may be further improved.

In addition, it is possible to respond to the movement of the head part 1 facing any directions including left-and-right and front-and-back directions by forming the rhombus-shaped ribs 1242 as shown in FIG. 4, and therefore, it is possible to support the cleaning sheet P more efficiently.

Moreover, since the longitudinal-edge recessed parts 122 and the transverse-edge recessed parts 123 are formed on the lower surface side of the bottom surface part 12, the dust on the floor surface is introduced to the lower surface of the head part 1 without being gathered at the end parts of the head part 1, and as a result, the dust collection property may be further improved.

The effect of the present invention to improve the dust collection property by the cleaning sheet P supported by the line-shaped ribs 124 becomes more evident when the cleaning sheet P is formed in concavo-convex shapes by an embossing process or a similar process.

Particularly, the concavo-convex shapes of the cleaning sheet P is provided as a purpose of improving the dust collection property by the cleaning sheet P not contacting the floor surface homogeneously mainly with such concavo-convex shapes. According to the invention, since there are sections of the concavo-convex shapes of the cleaning sheet P that are supported by the line-shaped ribs 124 and that are not supported by the line-shaped ribs 124, the concavo-convex shapes crush irregularly and the cleaning sheet P changes the way to contact the floor surface even more when cleaning, and therefore, the collection property may be improved. Specifically, the concavo-convex shapes of the cleaning sheet P is supported sufficiently by forming the ribs in line-shapes, and therefore, it is possible to obtain the effect described above.

Figure 8:
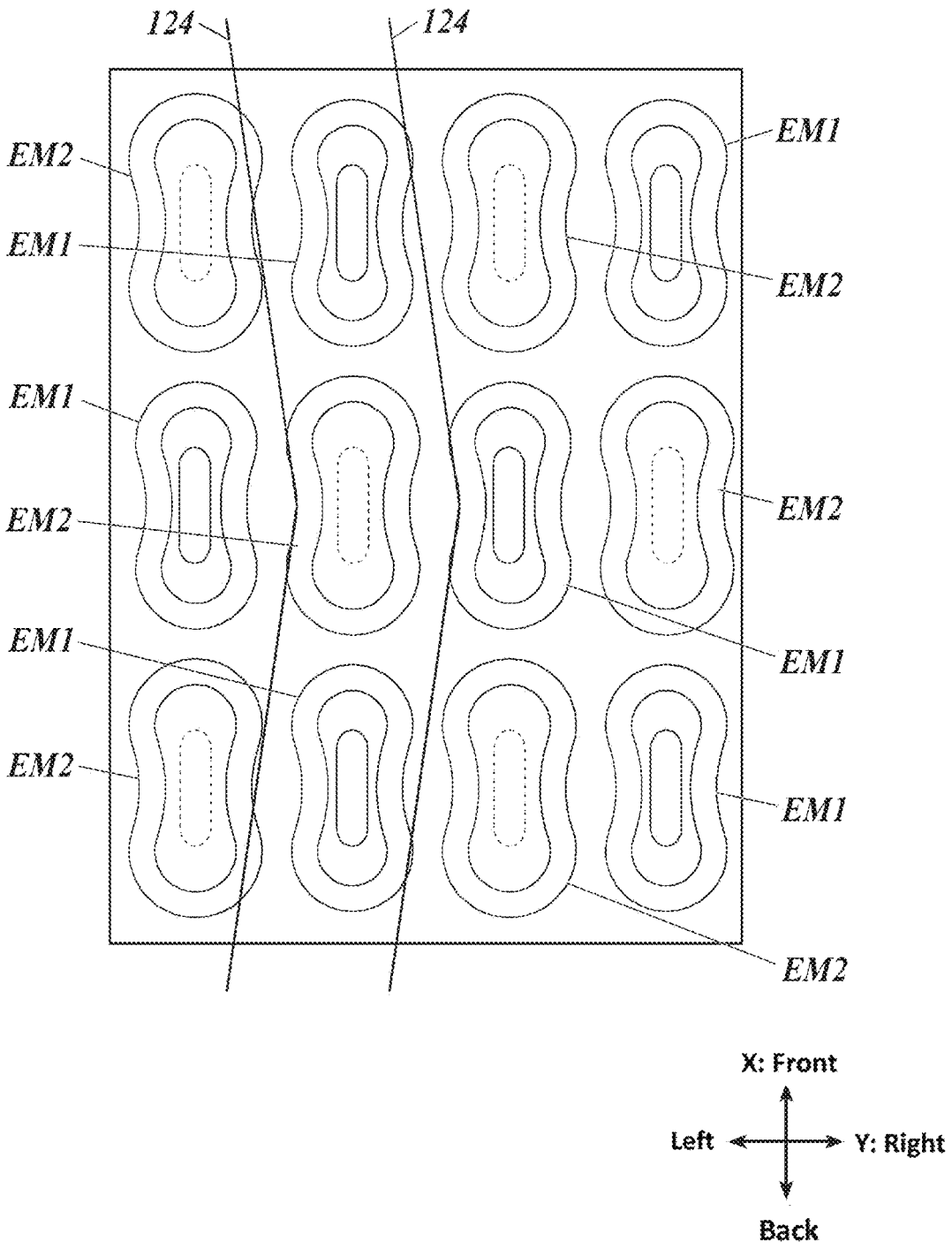
FIG. 8 is a view showing part of the cleaning sheet used to attach to the cleaning tool and an example of an arrangement of the line-shaped ribs with respect to embosses of the cleaning sheet.

More specifically, as shown in FIG. 8, for example, when using the cleaning sheet P formed as the convex embosses EM1 forming the convex shapes on the upper surface side of the sheet and the concave embosses EM2 forming the convex shapes on the lower surface side of the sheet that are arranged alternately with respect to the X-axis direction and the Y-axis direction in a plan view, the concavo-convex shapes are supported sufficiently by forming ribs in the line-shapes along the embosses side-by-side in the X-axis direction. The arrangement of the line-shaped ribs 124 described in FIG. 8 is only as an example and is not limited thereto.

EXAMPLES

Next, results obtained by evaluating cleaning areas with the cleaning sheet P according to Examples and Comparative Examples of the invention will be described. Hereinafter, the invention will be specifically described by way of Examples, but the invention is not limited thereto.

Example 1

The top surface part was formed in a rectangular shape in a plan view with a long side of 240 mm and a short side of 95 mm by using ABS resin and the bottom surface part was formed in a rectangular shape in a plan view with a long side of 248 mm and a short side of 98 mm by using elastomer (TPE) having a hardness of 70 degrees. The handle part is formed as the length from the connecting part of the head part to the upper end part of the grip part became 215 mm.

Figure 9A:
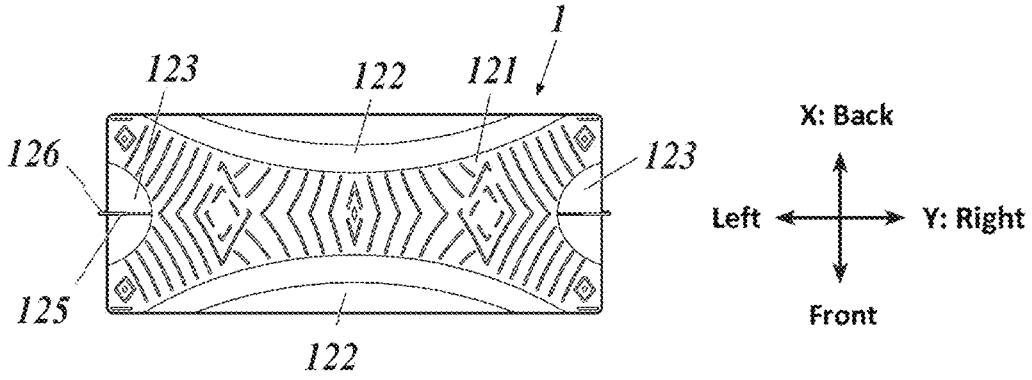
FIG. 9A is a brief bottom surface view of the cleaning tool according to Example 1.

The lower surface of the bottom surface part of the cleaning tool described above was formed as shown in FIG. 9A, specifically, as follows.

The line-shaped ribs were formed with ribs in line-shapes of 0.3 mm downward and a 1 mm width, with which the oblique-line ribs were formed to have curved shapes with a length of 10 mm to 80 mm and the rhombus-shaped ribs were formed to have a size of 50 mm in the X-axis direction and 28 mm in the Y-axis direction as a larger one and a size of 14 mm in the X-axis direction and 11 mm in the Y-axis direction as a smaller one.

The oblique-line ribs were arranged at intervals of 6 mm at the narrowest part and 9 mm at the widest part. Four rhombus-shaped ribs were arranged at positions 10 mm in the oblique directions from four corners, and one in the center and two in the middle positions between the center and end parts were arranged.

The end-part ribs were formed so that a height from the flat surface part on the lower surface of the bottom surface part was 2 mm downward, a length in the Y-axis direction was 23 mm and a width in the X-axis direction was 1 mm. The end-art protrusions were formed so that a height from the flat surface part on the lower surface of the bottom part was 2 mm downward and 1.5 mm in the Y-axis direction.

Thirty-six oblique-line ribs, seven rhombus-shaped ribs including larger ones and smaller ones and two end-part ribs including left and right ones were formed.

As the cleaning sheet, a dry sheet formed in a rectangular shape with a long side of 300 mm and a short side of 200 mm and had a 100 gsm in weighing, to which an emboss processing was performed, was used. Specifically, the cleaning sheet was formed to have convex embosses and concave embosses as shown in FIG. 8, and each emboss had 8 mm in a long-side direction, 3 mm in a short-side direction and 0.8 mm in height. A direction in which the emboss is elongated in a plan view, namely, the X-axis direction in FIG. 8 is defined as the long-side direction, and a direction in which the emboss is short in a plan view, namely, the Y-axis direction in FIG. 8 is defined as the short-side direction.

Moreover, non-woven fabric mainly composed of polyethylene-terephthalate was used as a hydrophobic fiber for an outer layer of the cleaning sheet, and a fiber mainly composed of polypropylene was used as a hydrophobic fiber for an inner layer of the cleaning sheet.

Concerning details of the composition of the outer layer, a chemical fiber mainly composed of polyethylene-terephthalate, polypropylene, polyethylene and the like is applied. Specifically, the outer layer is composed of 100% hydrophobic fiber, in which 80% polyethylene-terephthalate is contained as the hydrophobic fiber and 20% core-sheath fibers of polypropylene and polyethylene are contained as binder fibers. The polyethylene-terephthalate fiber with a fineness of 3.3 dtex and the binder fibers with a fineness of 1.7 dtex were used.

The inner layer was formed of spun bond non-woven fabric of 100% polypropylene.

Spun lace non-woven fabric of a three-layer structure was formed by combining the inner and outer layers using hydroentanglement.

Although the dry sheet was used in the embodiment, a wet sheet may also be used.

Example 2

Figure 9B:
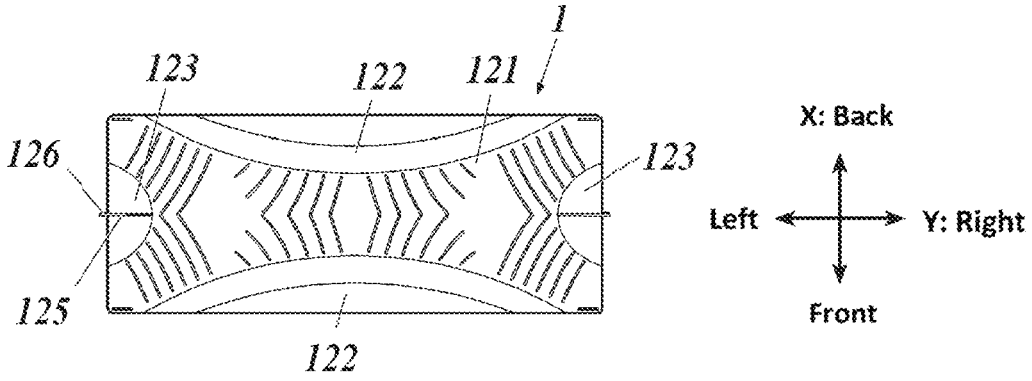
FIG. 9B is a brief bottom surface view of the cleaning tool according to Example 2.

FIG. 9B shows the cleaning tool that ribs were formed on the back surface of the head part 1, specifically, as follows.

The oblique-line ribs were formed to have curved shapes with a height of 0.3 mm downward, a 1 mm width and a length of 10 mm to 80 mm, with which were arranged at intervals of 6 mm at the narrowest part and 9 mm at the widest part.

Thirty-six oblique-line ribs and two end-part ribs including left and right ones were formed.

Other structures were the same as those of Example 1.

Example 3

Figure 9C:
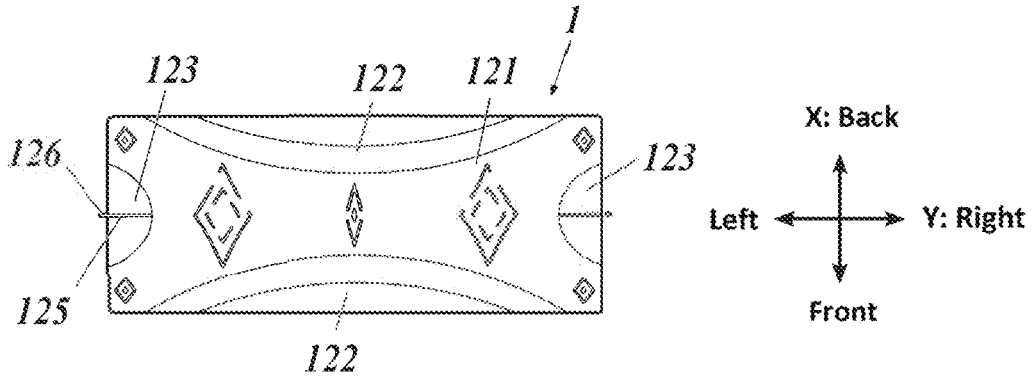
FIG. 9C is a brief bottom surface view of the cleaning tool according to Example 3.
Figure 9D:
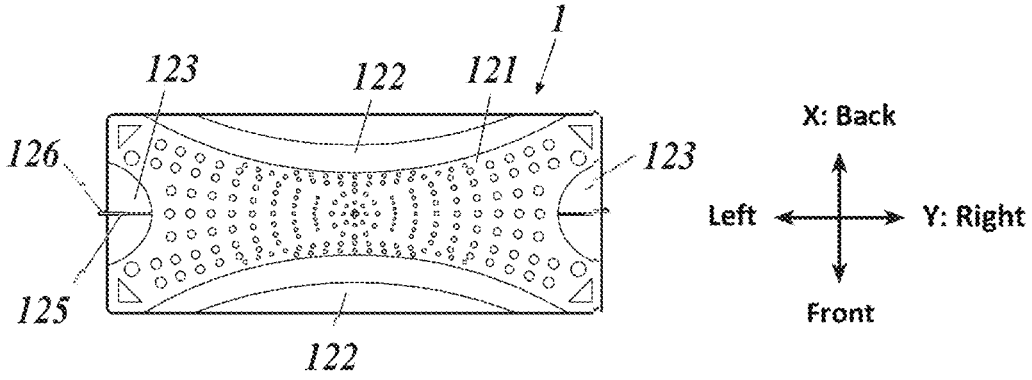
FIG. 9D is a brief bottom surface view of the cleaning tool according to Comparative Example 1.

FIG. 9C shows the cleaning tool that ribs were formed on the back surface of the head part 1, specifically, as follows.

Rhombus-shaped ribs were formed to have a size of 50 mm in the X-axis direction and 28 mm in the Y-axis direction as a larger one and a size of 14 mm in the X-axis direction and 11 mm in the Y-axis direction as a smaller one. Four rhombus-shaped ribs were arranged at positions 10 mm in the oblique directions from four corners, and one in the center and two in the middle positions between the center and end parts were arranged.

Seven rhombus-shaped ribs including larger ones and smaller ones and two end-part ribs including left and right ones were formed.

Other structures were the same as those of Example 1.

Comparative Example 1

FIG. 91) shows the cleaning tool that ribs were formed on the back surface of the head part 1, specifically, as follows.

Dot-shaped ribs having diameters of 5 mm to 8 mm were arranged so as to gradually increase in size in the direction from the central part to the edge parts at 10 mm intervals. Hundred ten dot-shaped ribs were formed and two end-part ribs including left and right ones were formed.

Other structures were the same as those of Example 1.

Comparative Example 2

Figure 9E:
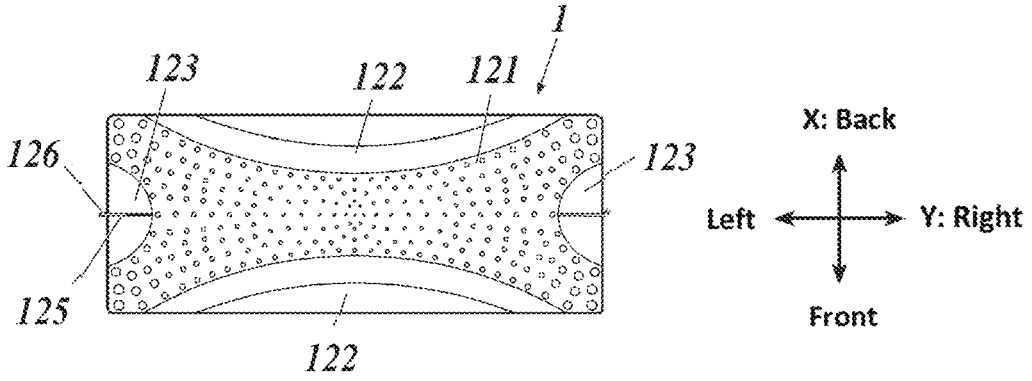
FIG. 9E is brief bottom surface view of the cleaning tool according to Comparative Example 2.

FIG. 9E shows the cleaning tool that ribs were formed on the back surface of the head part 1, specifically, as follows.

Dot-shaped ribs having diameters of 1 mm to 5 mm were arranged so as to gradually increase in size in the direction from the central part to the edge parts at 5 mm intervals. Two hundred twenty dot-shaped ribs were formed and two end-part ribs including left and right ones were formed.

Other structures were the same as those of Example 1.

Comparative Example 3

Figure 9F:
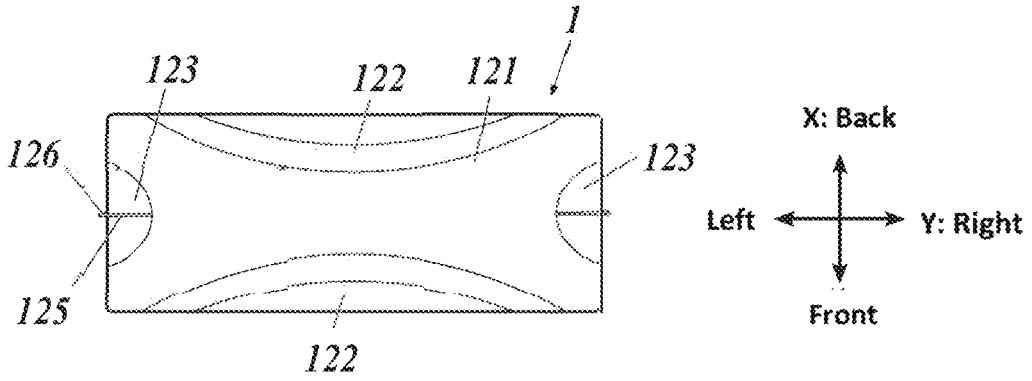
FIG. 9F is a brief bottom surface view of the cleaning tool according to Comparative Example 3.

FIG. 9F shows the cleaning tool that ribs were not formed on the back surface of the head part 1. Other structures were the same as those of Example 1.

Evaluation of the dust collection property was performed by attaching the cleaning sheet to the cleaning tool of Examples 1 to 3 and Comparative Example 1 to 3 and by cleaning with the head part 1 that was moved in the short-side direction.

The evaluation results are shown in Table 1. The criteria for the evaluation are as follows:

Excellent: Satisfied

Good: Almost satisfied although some dust or the like remained

Fair: Not satisfied much because dust remained

Poor: Not satisfied at all because dust was not collected well

TABLE 1

| | Example 1 | Example 2 | Example 3 | Comparative Example 1 | Comparative Example 2 | Comparative Example 3 |
|---|---|---|---|---|---|---|
| Collection Properties | Excellent | Good | Fair | Fair | Fair | Poor |

(Evaluation)

According to comparison of Examples 1 to 3 and Comparative Examples 1 to 2 with Comparative Example 3, the dust collection property of the cleaning sheet has been shown to improve by providing ribs on the back surface of the head part.

According to comparison of Examples 1 to 2 with Comparative Example 1 to 2, the dust collection property of the cleaning sheet has been shown to improve more by forming ribs in the line-shapes on the back surface of the head part. In addition, regarding Example 3, although the evaluation is "Fair" which is the same as Comparative Examples 1 and 2, forming ribs in rhombus-shapes has shown high efficiency considering the area that ribs are formed in Example 3 is small and ribs are formed over the extensive area in Comparative Examples 1 and 2, but they showed similar results.

Further, according to comparison of Examples 1 with other Examples and Comparative Examples, the dust collection property of the cleaning sheet has been shown to improve most when arranging the line-shaped ribs as described in the embodiment.

The present invention may be suitably utilized in a manufacturing field of the cleaning tool.

The invention claimed is:

1. A cleaning tool comprising:

a head part to which a cleaning sheet is attached, the head part having a bottom surface;

a flat surface part formed on the lower surface side of the bottom surface;

a plurality of line-shaped ribs disposed on the bottom surface and protruding downwardly therefrom;

a handle part connected to the head part for a user to grip; and a pair of longitudinal-edge recessed parts;

wherein each of the longitudinal-edge recessed parts extends to a respective longitudinal edge of the bottom surface and is located between ends of the respective longitudinal edge, the width of each of the longitudinal-edge recessed parts increasing with proximity to the longitudinal edge.

2. The cleaning tool according to claim 1, wherein the head part is formed in a rectangular shape in a plan view; and the line-shaped ribs disposed on the bottom surface of the head part include oblique-line ribs inclining from a central longitudinal axis and a transverse edge of the bottom part towards a central transverse axis and a longitudinal edge of the bottom part.

3. The cleaning tool according to claim 2, wherein the line-shaped ribs include rhombus-shaped ribs formed along and symmetrical to the longitudinal axis of the bottom part.

4. The cleaning tool according to claim 3, wherein the oblique-line ribs are disposed between the rhombus-shaped ribs.

5. The cleaning tool according to claim 2, wherein lengths of the line-shaped ribs are 1 mm to 100 mm.

6. The cleaning tool according to claim 2, wherein the line-shaped ribs are formed as to have convex configurations with 0.1 to 2 mm in height downward from the bottom surface of the head part.

7. The cleaning tool according to claim 2, wherein the line-shaped ribs are formed on the bottom surface of the head part except the area of the longitudinal-edge recessed parts.

8. The cleaning tool according to claim 2, further comprising a pair of transverse-edge recessed parts, wherein each of the transverse-edge recessed parts extends to a respective transverse edge of the bottom surface and is located between ends of the respective transverse edge, the width of each of the recessed parts increasing with proximity to the transverse edge.

9. The cleaning tool according to claim 8, wherein the line-shaped ribs are formed on the bottom surface of the head part except the area of the longitudinal-edge recessed parts and the area of the transverse-edge recessed parts.

10. The cleaning tool according to claim 1, wherein the line-shaped ribs include rhombus-shaped ribs formed along and symmetrical to the longitudinal axis of the bottom part.

11. The cleaning tool according to claim 10, wherein lengths of the line-shaped ribs are 1 mm to 100 mm.

12. The cleaning tool according to claim 10, wherein the line-shaped ribs are formed as to have convex configurations with 0.1 to 2 mm in height downward from the bottom surface of the head part.

13. The cleaning tool according to claim 10, wherein the line-shaped ribs are formed on the bottom surface of the head part except the area of the longitudinal-edge recessed parts.

14. The cleaning tool according to claim 1, wherein lengths of the line-shaped ribs are 1 mm to 100 mm.

15. The cleaning tool according to claim 14, wherein the line-shaped ribs are formed as to have convex configurations with 0.1 to 2 mm in height downward from the bottom surface of the head part.

16. The cleaning tool according to claim 1, wherein the line-shaped ribs are formed as to have convex configurations with 0.1 to 2 mm in height downward from the bottom surface of the head part.

17. The cleaning tool according to claim 1, wherein the line-shaped ribs are formed on the bottom surface of the head part except the area of the longitudinal-edge recessed parts.

18. The cleaning tool according to claim 1, further comprising a pair of transverse-edge recessed parts, wherein each of the transverse-edge recessed parts extends to a respective transverse edge of the bottom surface and is located between ends of the respective transverse edge, the width of each of the recessed parts increasing with proximity to the transverse edge.

19. The cleaning tool according to claim 18, wherein the line-shaped ribs are formed on the bottom surface of the head part except the area of the longitudinal-edge recessed parts and the area of the transverse-edge recessed parts.

* * * * *